US005920028A

United States Patent [19]

Guhring et al.

[11] Patent Number: 5,920,028

[45] Date of Patent: Jul. 6, 1999

[54] SELF-LOADING RIFLE WITH A ROTATABLE BREECH BLOCK HEAD

[75] Inventors: Manfred Guhring; Helmut Weldle, both of Oberndorf, Germany

[73] Assignee: Heckler & Koch, GmbH, Germany

[21] Appl. No.: 08/847,383

[22] Filed: Apr. 24, 1997

[30] Foreign Application Priority Data

Apr. 24, 1996 [DE] Germany ..... 196 16 397

[51] Int. Cl.[6] ..... F41A 19/27

[52] U.S. Cl. ..... 89/188; 42/16

[58] Field of Search ..... 89/188; 42/16

[56] References Cited

U.S. PATENT DOCUMENTS 2,146,743 2/1939 Johnson, Jr. ..... 89/188
5,722,194 3/1998 Würger et al. ..... 89/188

*Primary Examiner*—Charles T. Jordan
*Assistant Examiner*—Matthew J. Lattig
*Attorney, Agent, or Firm*—Leydig, Voit & Mayer, Ltd.

[57] ABSTRACT

A locking mechanism for a self-loading hand-held firearm includes a breech block carrier mounted for sliding movement in the longitudinal direction of the weapon and a breech block head which is rotatable about a longitudinal axis between a locked position and an unlocked position. The breech block head has a transverse control pin which is received in an oblique sliding guide formed in the breech block carrier. The sliding guide has first and second guide edge opposite to each other with different angles of inclination with respect to the longitudinal axis.

4 Claims, 1 Drawing Sheet

SELF-LOADING RIFLE WITH A ROTATABLE BREECH BLOCK HEAD

FIELD OF THE INVENTION

This invention relates generally to the weaponry art, and more particularly to a locking mechanism for a self-loading hand-operated firearm.

BACKGROUND OF THE INVENTION

Many self-loading hand-operated firearms use locking arrangements which include a breech block carrier and a breech block head. The breech block carrier is movable in a defined path along the longitudinal axis of the weapon. The breech block head is carried by the breech block carrier for sliding movement and is rotatable about a longitudinal axis for locking and unlocking. The breech block head has a control pin on its rear portion which extends transversely to the longitudinal direction. The control pin is received in a sliding guide formed in the breech block carrier. The sliding guide extends obliquely to the longitudinal direction and is bounded by first and second guide edges.

During a shooting operation, the breech block carrier moves back and forth to cause ejection of a fired cartridge case and loading of a new cartridge. At the beginning of the opening movement of the breech block carrier, the breech block head is in its locked position. As the carrier moves rearward, the first guide edge engages and acts on the control pin to cause the breech block head to rotate to an unlocked position. The breech block head is then carried rearward by the breech block carrier. Shortly before the end of the forward closing movement of the breech block carrier, the breech block head engages the rear end of barrel and ceases movement along the longitudinal axis. The second guide edge of the sliding guide of the breech block carrier, which is still moving, contacts and acts on the control pin to cause the breech block head to rotate into its locked position. An example of firearms using this type of locking arrangement is the U.S. M16 automatic rifle.

Generally, the closing movement of the breech block carrier/head assembly should occur as rapidly as possible. This not only allows for a faster firing sequence but also causes cartridge being loaded to move as expediently as possible through a loading zone in which it is not completely guided. In this way, disturbances in the loading process are minimized such as in cases where the weapon is held in an oblique or even up-side-down position. The control pin, of course, cannot strike the end of the sliding guide so hard as to cause damage.

It is therefore desirable that the entire breech block assembly moves as quickly as possible in the closing movement over as much of its distance of travel as possible. Consequently, the angle that the sliding guide forms with the longitudinal direction is typically made very large so that the locking occurs in an end section of the closing movement that is as short as possible.

In many applications, such as military operations, hunting, or police actions, a firearm is often carried for a relatively long period of time in a state ready to be fired or loaded, without any opportunity for cleaning the weapon. In such a case, sand, dust or mud will unavoidably be deposited in the mechanisms of the weapon. Accordingly, the weapon may become jammed in the reloading process because the recoiling movement of the breech block assembly is hampered by the accumulated dirt.

Faulty ammunition may also cause the weapon to become jammed. For instance, inexperienced users tend to excessively oil the barrels of firearms. If a loaded cartridge is for some reason not entirely oil-tight, excessive oil can enter the cartridge and render a portion of the propellant ineffective and result in the so called "check shot." In such a case, the combustion gas of the faulty cartridge may be too weak to complete the recoiling movement of the breech block assembly.

SUMMARY OF THE INVENTION

Accordingly, it is an object of the present invention to provide an improved locking mechanism for self-loading hand-operated firearms that more effectively addresses the above-described deficiencies than was hitherto possible in the described state of the art.

It is a more particular object of the invention to provide a locking arrangement that allows rapid closing movement of the breech block assembly but at the same time can be opened with a relatively low force.

It is a further object of the invention to provide a locking arrangement that achieves rapid closing movement and reduced unlocking force of the breech block assembly without requiring complicated modifications to existing constructions of locking mechanisms for self-loading firearms.

The present invention meets these and other objects with a firearm locking arrangement in which a breech block head is rotated at different speeds in its locking and unlocking operations. The breech block head is coupled to a breech block carrier by a transverse control pin disposed on the breech block head and a sliding guide in the breech block carrier. The control pin is received in the sliding guide for guided movement. The sliding guide is obliquely oriented with respect to the longitudinal axis of the firearm and has first and second guide edges. The first guide edge engages the control pin during the opening movement of the breech block assembly to cause the breech block head to rotate to its unlocked position. The second guide edge, on the other hand, engages and acts on the control pin during the closing movement of the breech block assembly to cause the breech block head to rotate to its locked position. The inclination angle of first guide with respect to the longitudinal axis is less than that of the second guide edge. The reduced first guide edge angle reduces the force required to unlock the breech block head. The larger angle of the second guide edge allows rapid closing movement of the breech block.

Other objects and advantages will become apparent with reference to the following detailed description when taken in conjunction with the drawings in which:

Figure 1:
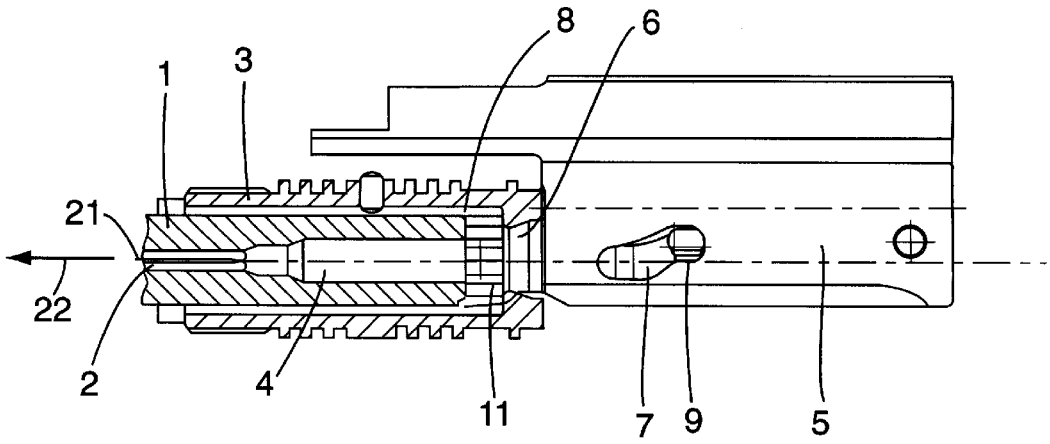
FIG. 1 is a partial cross sectional view of a self-loading rifle having a breech block carrier/head assembly constructed according to the invention, with the breech block head in a locked position.

While the invention is susceptible of various modifications and alternative constructions, certain illustrated embodiments hereof have been shown in the drawings and will be described below. It should be understood, however, that there is no intention to limit the invention to the specific forms disclosed, but, on the contrary, the intention is to cover all modifications, alternative constructions and equivalents falling within the spirit and scope of the invention as defined by the appended claims.

DETAILED DESCRIPTION OF THE PREFERRED EMBODIMENT

Generally, the present invention relates to a locking mechanism for a self-loading hand-held firearm. The locking mechanism includes a breech block assembly which comprises a breech block carrier and a breech block head operatively coupled such that the translational movement of the breech block carrier causes the rotational movement of the breech block head for locking and unlocking operations.

Turning now to the drawings, FIG. 1 shows, in a fragmentary sectional view, a rapid firing rifle with a breech block assembly constructed according to the invention. The rifle includes a rifle barrel 1 having a bore 2. The bore axis of the barrel is designated as the longitudinal axis 21 of the weapon. The arrow 22 in FIG. 1 is oriented along the longitudinal axis in the direction of the muzzle of the rifle and defines a forward direction of the weapon. The position indications used hereinafter, such as "in front," "to the rear," etc., are referenced with respect to this direction.

The rear end of the rifle barrel 1 is fixedly fastened in a locking sleeve 3 on which the weapon housing (not shown) is attached. A cartridge chamber 4 is formed in the end portion or the barrel 1. The rear end of the locking sleeve 3 has an annular opening 6 which has axial grooves formed in its inner wall surface. The groves are angularly spaced from each other and each has a generally rectangular cross section. A cylindrical chamber 8 is formed between the front end of the opening 6 and the rear end of the rifle barrel 1. The inner diameter of the cylindrical chamber 8 is about the same as the diameter of the cylindrical surface defined by bottoms of the axial grooves in the opening 6.

Figure 2:
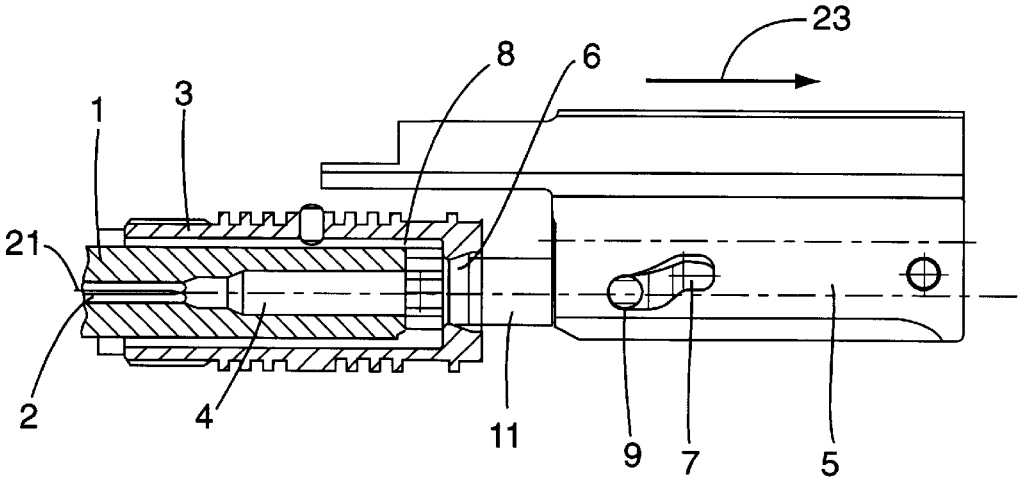
FIG. 2 is similar to FIG. 1 but with breech block carrier moved rearward and the breech block head in an unlocked position.

The breech block assembly includes a breech block carrier 5 and a breech block head 11. For clarity of description, the breech block carrier and the breech block head are hereinafter referred to as the "carrier" and the "head," respectively. The front portion of the head 11 has a cross section complementary to the opening of the locking sleeve 3, with axial ridges formed thereon which correspond to the axial grooves in the opening. The length of the front portion of the head 11 corresponds to the length of the cylindrical chamber 8. When head 11 and the opening 6 are aligned, the head may be introduced through the opening into the cylindrical chamber 8. If the head 11 is then rotated in the cylindrical chamber 8, its ridges engage the cross pieces between the grooves of the locking sleeve 3. At the same time the head 11 is also seated or nearly seated on the rear end surface of the barrel 1. This position is the "locked" position of the head 11. In this position, the head cannot move in the longitudinal direction of the rifle barrel. When the head 11 is rotated back to its previous position in the chamber, i.e., the "unlocked" position, it can be withdrawn rearward out of the cylindrical chamber. The locked position of the head 11 is shown in FIG. 1, while the unlocked position is shown in FIG. 2.

The rotational movement of the head 11 in the cylindrical chamber 8 for locking and unlocking is guided by the carrier 5. The carrier 5, in turn, is guided in the weapon for sliding movement in the longitudinal direction 21. Coupling of the head 11 and the carrier 5 is accomplished with the use of a transverse control pin 9 disposed on the rear portion of the head and a sliding guide 7 formed in the carrier 5 in which the control pin 9 is received. In the preferred embodiment, the sliding guide 7 is constructed as a continuous oblong slot which extends through the wall of the carrier 5 but is shielded from the outside by the weapon housing (not shown).

Figure 3:
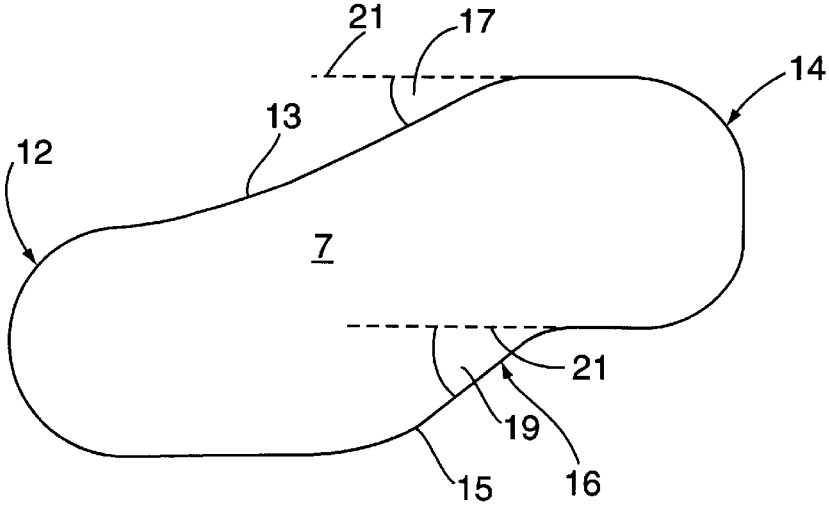
FIG. 3 is an enlarged view of the contour of a sliding guide formed in the breech block carrier shown in FIG. 1.

Turning now to FIG. 3, the front end section 12 and rear end section 14 of the sliding guide 7 extend parallel to the longitudinal axis and are joined by an oblique middle section 16 which is bound on two sides by the first and second guide edges 13 and 15. The first guide edge 13 forms a first angle 17 with respect to the longitudinal axis 21, while the second guide edge 15 forms a second angle 19 with respect to the longitudinal axis. The upper edge of the front end section 12 which is connected to the first guide edge 13 is significantly shorter than the lower edge connected to the second guide edge 15. The two edges of the rear end section 14 are about equal in length. When the head 5 is locked (FIG. 1), the carrier is in its foremost position and the control pin 9 lies adjacent the rear end section 14 of the sliding guide. When the head is unlocked (FIG. 2), the control pin is received in the front end section 12 of the sliding guide 7.

Returning now to FIGS. 1 and 2, after a shot is fired, the carrier 5 is moved rearward in the direction indicated by the arrow 23 to initiate the reloading process. During that movement, the control pin 9 engages the first guide edge 13 which, as described above, is inclined at an angle 17 with respect to the longitudinal axis 21. The engagement of the control pin 9 and the oblique first guide edge 13 causes the head 11 to rotate from the locked position (FIG. 1) toward the unlocked position (FIG. 2). In the illustrated embodiment, this rotation is counter-clockwise as seen from the rear of the weapon.

When the carrier 5 has traveled sufficiently far with respect to the head 11, the unlocking rotary movement of the head is completed. The control pin 9 strikes against the front end of the sliding guide 7, and aligns the head with the opening 6 in the locking sleeve 3. The head 11 is then carried rearward by the carrier 5 out of the cylindrical chamber 8. Ejection of a fired cartridge case and the loading of a new cartridge are then carried out in a manner known to those skilled in the art. Afterward, the carrier 5 and the head 11 move forward together until the head engages the rear end of the rifle barrel 1. During the forward movement, the control pin 9 assumes a position in the sliding guide 7 that is somewhere behind the front end of the sliding guide and in front of the second guide edge 15, which is inclined at an angle 19 with respect to the longitudinal axis.

After the forward movement of the head 11 is restricted by contacting the end of the barrel, the carrier 5 continues to move forward. This causes the second guide edge 15 to engage the control pin 9 and, due to the inclination of the second guide edge, urges the control pin to rotate toward the locked position. The locking rotation in the illustrated embodiment is in the clockwise direction when viewed from the rear of the weapon. When the carrier 5 reaches its front end position, the head 11 has completed its locking rotation and is now in the locked position (FIG. 1).

In accordance with a feature of the invention, the first guide edge 13 and the second guide edge 15 of the sliding guide 7 are not parallel but are formed at different angles with respect to the longitudinal axis of the weapon. As can be best seen in FIG. 3, the angle 17 between the first guide edge 13 and the longitudinal axis 21 is significantly smaller (or flatter) than the angle 19 between the second guide edge 15 and the longitudinal axis. Due to the different inclination angles of the first and second guide edges 13 and 15, the conversion from the rearward motion of the carrier 5 to the unlocking rotary movement of the head 11 is easier than that between the forward motion of the carrier and the locking rotary movement of the head. Thus, in sharp contrast to prior art arrangement in which the locking and unlocking forces are about the same, the present invention has the important advantage that the force required to unlock the head 11 is significantly less than the force required to lock the head 11.

With the significant reduction of the required unlocking force, combustion pressure of a faulty cartridge that is too weak to carry out an unlocking operation in the prior art arrangements may nevertheless be sufficient for unlocking the head in the arrangement of the invention. Moreover, the likelihood of jamming due to resistance caused by severe fouling of the cartridge chamber is also substantially reduced. The reduced force required to unlock the head ensures that the breach block assembly has the necessary kinetic energy to execute recoil movement to a degree sufficient to carry out a successful loading operation. The reduced force required to open the breech block also facilitates manual unloading of the weapon.

In the preferred embodiment described above, the sliding guide is formed as an elongated through-hole or slot in a side wall of the carrier 5. With this through-hole construction, external contamination that works its way into the oblong hole is likely to be thrust out by the movement of the control pin. Alternatively, the sliding guide may be formed by two surfaces formed in the carrier 5 which are not directly connected to each other. It is also possible to form the sliding guide as a curved groove in the carrier which is not open to the outside to prevent dirt from the outside to enter the sliding guide.

The first guide edge 13 in the lateral arrangement of the sliding guide 7 preferably overlies the second guide edge 15. This is achieved by corresponding choice of the rotational directions of the head 11 for locking and unlocking. If dirt accumulates in the weapon, the danger of fouling for the upper first guide edge is expected to be smaller than that for the lower second guide edge.

The self-loading weapon of the invention is preferably provided with a gas-pressure loading arrangement, in which a gas piston received in a gas chamber is coupled to the breech block carrier 5 to transfer a recoil force generated by combustion gas pressure to the carrier. The advantages of the invention are especially significant in this arrangement. This is because the prior art addresses the problem of high unlocking force by increasing the size of a gas nozzle which leads the combustion gas from the barrel to the gas chamber so that more gas is diverted from the barrel into the gas chamber to provide a higher driving force on the piston. In order to ensure that a sufficient force is provided for unlocking, such an arrangement often diverts significantly more combustion gas into the gas chamber than is necessary. Although some weapons allow the user to adjust the dimension of the gas nozzle, improper nozzle adjustments, however, could cause damage to the weapon or impair its functional reliability.

It should now become clear that the invention provides a self-loading firearm that requires a significantly reduced unlocking force as compared to the locking force required. The reduction of the unlocking force is achieved by constructing the sliding guide, which converts the sliding motion of the carrier into the rotary motion of the head, such that the guide edge for unlocking the head has a much smaller inclination angle than that of the guide edge for locking the head. As a result, the opening of the weapon is made significantly easier without compromising the rapid closing movement of the breech block assembly. The reduced unlocking force ensures proper operation of the weapon even in cases of weak combustion due to faulty cartridges or higher resistance caused by fouling.

What is claimed is:

1. A self-loading hand-operated firearm comprising:

a breech block carrier guided for sliding movement along a longitudinal axis of the firearm, the breech block carrier having a sliding guide forming therein extending obliquely with respect to the longitudinal axis, the sliding guide having first and second guide edges, the first and second guide edges having first and second angles with respect to the longitudinal axis, respectively, wherein the first angle is less than the second angle; and a breech block head guided for sliding movement along the longitudinal axis of the firearm and rotatable about the longitudinal axis between a locked position and an unlocked position, the breech block head having a control pin extending transverse to the longitudinal axis disposed to engage the sliding guide to couple the breech block head to the breech block carrier, the first guide edge engaging the control pin during an opening movement of the breech block carrier to cause the breech block head to rotate into the unlocked position, the second guide edge engaging the control pin during a closing movement of the breech block carrier to cause the breech block head to rotate into the locked position.

2. A self-loading hand-operated firearm as in claim 1, wherein the sliding guide comprises an oblong slot formed in the breech block carrier and having a front end section, a rear end section, and an oblique transition section which is bounded by the first and second guide edges.

3. A self-loading hand-operated firearm as in claim 1, wherein the first guide edge overlies the second guide edge when the firearm is held in a normal operating position.

4. A self-loading hand-operated firearm as in claim 1, wherein the opening movement of the breech block carrier is energized by combustion gas.

* * * * *